US005479988A

United States Patent [19]

Appleton

[11] Patent Number: 5,479,988

[45] Date of Patent: Jan. 2, 1996

[54] MUD CHECK VALVES IN DRILLING APPARATUS (WELLS)

[75] Inventor: Robert P. Appleton, Glenburn House, Tornaveen, Torphins, Aberdeenshire, AB31 4NY, Scotland, United Kingdom

[73] Assignee: Robert Patrick Appleton, Aberdeenshire, United Kingdom

[21] Appl. No.: 244,481

[22] PCT Filed: Nov. 27, 1992

[86] PCT No.: PCT/GB92/02198

§ 371 Date: Jul. 18, 1994

§ 102(e) Date: Jul. 18, 1994

[87] PCT Pub. No.: WO93/11336

PCT Pub. Date: Jun. 10, 1993

[30] Foreign Application Priority Data

Nov. 30, 1991 [GB] United Kingdom ..... 9125551

[51] Int. Cl.[6] ..... E21B 34/06; E21B 21/10; E21B 3/02; F16K 17/196

[52] U.S. Cl. ..... 166/325; 166/332.6; 137/496

[58] Field of Search ..... 166/325, 319, 166/321, 332; 137/68.1, 71, 496, 497, 516.11, 516.15

[56] References Cited

U.S. PATENT DOCUMENTS

| | | | |
|---|---|---|---|
| 449,768 | 4/1891 | Ward . | |
| 3,385,370 | 5/1968 | Knox et al. | 166/325 X |
| 3,599,713 | 8/1971 | Jenkins . | |
| 3,603,394 | 9/1971 | Raulins | 166/325 |
| 3,698,411 | 10/1972 | Garrett | 166/325 X |
| 3,965,980 | 6/1976 | Williamson . | |
| 3,967,679 | 7/1976 | Liljestrand . | |
| 3,973,586 | 8/1976 | Hill et al. . | |
| 3,973,587 | 8/1976 | Cochran | 137/496 |
| 4,072,166 | 2/1978 | Tiraspolsky et al. | 137/496 |
| 4,364,407 | 12/1982 | Hilliard . | |
| 4,625,755 | 12/1986 | Reddoch | 166/35 X |
| 4,834,193 | 5/1989 | Leltko, Jr. . | |
| 4,899,837 | 2/1990 | Baugh | 166/325 X |
| 4,962,819 | 10/1990 | Bailey et al. | 166/325 X |

*Primary Examiner*—Ramon S. Britts
*Assistant Examiner*—Frank S. Tsay
*Attorney, Agent, or Firm*—Young, MacFarlane & Wood

[57] ABSTRACT

A check valve for connection with the top end of a drillstring as a mud saver comprises a tubular valve member (18) which is axially shiftable within a tubular body (10) through a sleeve seal (19) which is mounted in the body (10) and which cooperates with ports in the wall of the tubular valve member (18) and which is disposed adjacent a downstream end of the tubular valve member. A compression spring (20) urges the tubular valve member (18) in the upstream direction into abutment with an upstream stop (15). The downstream end of the tubular valve member is closed by means of a frangible glass disc (21). The sleeve seal (19) is also axially shiftable in the body (10) in an upstream direction away from a downstream stop (17) and the compression spring (20) urges the sleeve seal (19) in the downstream direction. In a compact arrangement, the tubular valve member (18) is housed within an upstream hollow pin (30) of a saver sub particularly suited to a top drive arrangement.

9 Claims, 2 Drawing Sheets

MUD CHECK VALVES IN DRILLING APPARATUS (WELLS)

BACKGROUND OF THE INVENTION

This invention relates to a check valve for connection with the top end of a drillstring as a mud-saver.

Mud-saver valves are installed at the lower end of a kelly for the purpose of checking outflow of drilling fluid from the kelly on disconnection of the kelly joint. Such mud-saver valves are also installed in a top drive system for the same purpose.

SUMMARY OF THE INVENTION

According to the present invention, there is provided a check valve for connection with the top end of a drillstring as a mud saver, comprising a tubular valve member axially shiftable within a tubular body through a sleeve seal mounted in the body and which cooperates with ports in the wall of the tubular valve member which ports are disposed adjacent a downstream end of the tubular valve member, spring means urging the tubular valve member in the upstream direction and into abutment with a first stop means, and a closure closing the downstream end of the tubular valve member; characterized in that the sleeve seal is axially shiftable in the body in an upstream direction away from a second stop means, and in that the said spring means urges the sleeve seal in the downstream direction.

Further, according to the present invention, there is provided a check valve for connection with the top end of a drillstring as a mud saver, comprising a tubular valve member axially shiftable within a tubular body through a sleeve seal mounted in the body and which cooperates with ports in the wall of the tubular valve member which ports are disposed adjacent a downstream end of the tubular valve member, spring means urging the tubular valve member in the upstream direction and into abutment with a first stop means, and a closure closing the downstream end of the tubular valve member; characterized in that the body is a saver sub having an upper externally screw-threaded hollow pin for connection with a drive member, and in that the said tubular valve member is housed within said hollow pin.

DESCRIPTION OF THE PREFERRED EMBODIMENT

Figure 1:
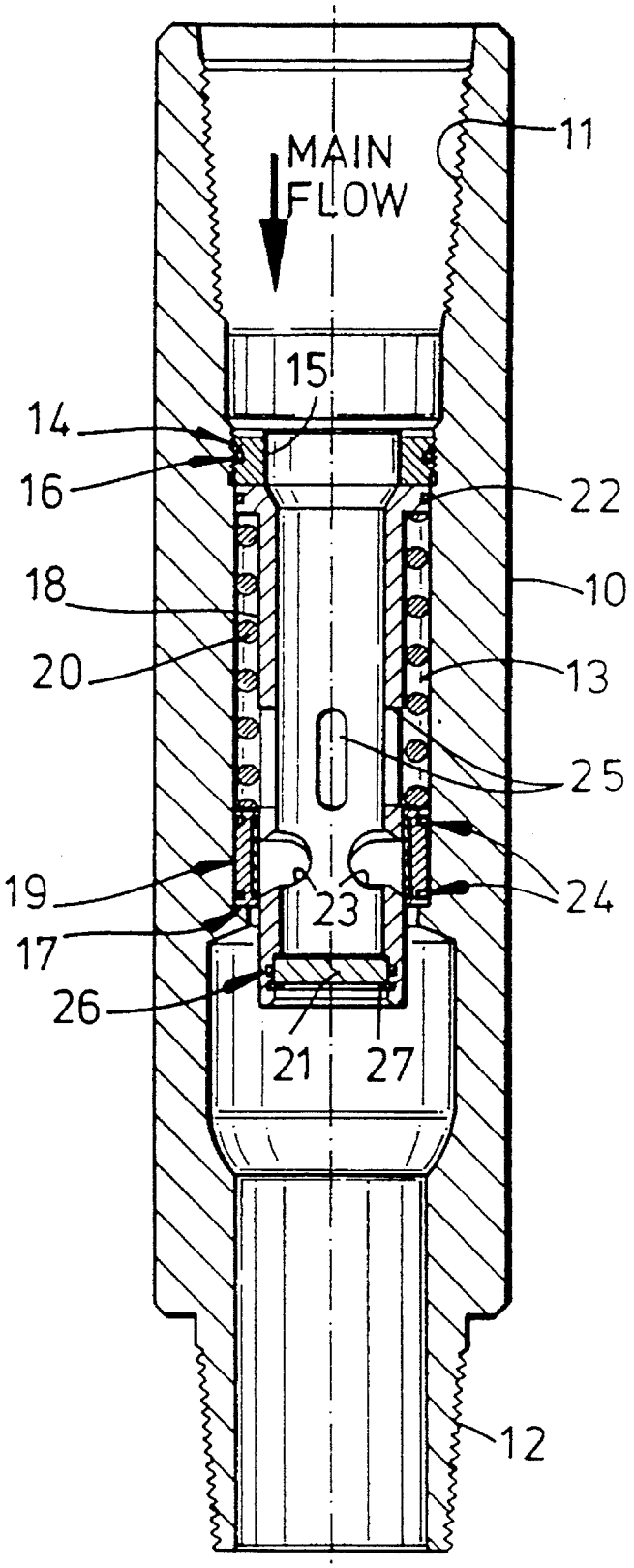
FIG. 1 is a sectional elevation of a first embodiment of a check valve in accordance with the present invention.

In FIG. 1 of the drawings, the check valve consists of a body 10 which is adapted for connecting in line coaxially with a kelly (not shown) and a drillstring (not shown). Thus, the check valve is inserted at the kelly joint which is the usual point of connection between the kelly and the drillstring. The top or input end of the check valve has a standard tapered screw-threaded box or socket 11; and the other end of the check valve has a standard tapered screw-threaded hollow pin 12. Alternative configurations of screw-threaded connectors may be chosen according to specific requirements, for example for use in a top drive system or in any arrangement of tubulars to check fluid loss.

An intermediate portion of the valve body 10 defines a cylindrical bore 13 at the upper end of which there is provided a screw-threaded portion 14 and a first or upstream stop means in the form of an annular retaining collar 15 which incorporates a fluid-tight seal 16. The lower end of the bore 13 defines a seconds or downstream stop means in the form of a step 17 which, in conjunction with the retaining collar 15 locates a fluid flow control means consisting of a tubular valve member 18, a sleeve seal 19, a compression spring 20, and a frangible closure in the form of a toughened soda-lime glass disc 21.

More particularly, the upper end of the tubular valve member 18 is flanged to define an annular piston 22 which slidably engages the bore 13 and provides an upper land for the compression spring 20. The lower end or downstream portion of the tubular valve member 18 is provided with streamlined openings or ports 23, and the same vicinity of the tubular valve member 18 is engaged by the sleeve seal 19 which is also slidably received in the bore 13 and is provided with sliding seals 24. The upper end face of the sleeve seal 19 provides a land for the lower end of the compression spring 20. The annular space between the tubular valve member 18 and the bore 13 is in communication with the interior of the tubular valve member 18 by way of four equi-angularly spaced slots 25 which serve to "vent" the said annular space and also allow for clearance therefrom of particles or other solid matter which may have settled out from the drilling fluid.

The glass disc 21 is located in a recess at the downstream end of the tubular valve member 18 together with a fluid tight seal 26; and the disc 21 is retained by a snap ring 27.

The strength or force of the compression spring 20 is determined with reference to the weight of a column of drilling mud above the check valve in the kelly or other tubular whilst the fluid is static. Thus, the spring strength is sufficient to support the weight of the mud column with the upper end of the tubular valve member 18 in abutment with the retaining collar 15 and the ports 23 within the sleeve seal 19. In this condition, the mud column within the kelly or other tubular is retained and the lower joint with the drillstring may be disconnected without any significant loss of drilling fluid.

In resuming drilling operations and mud pumping, the tubular valve member 18 is shifted axially downwards against the compression spring 20 by virtue of pressure drop over the tubular valve member 18 during flow of drilling fluid. Thus, the ports 23 discharge into the valve body 10 immediately below the sleeve seal 19, the main flow of drilling fluid being through the tubular valve member 18 and the ports 23.

Whilst the check valve is closed, and with the drillstring still connected, any "pressure kicks" within the drillstring will act on the lower end face of the sleeve seal 19 which may shift axially upwards against the compression spring 20 thereby relieving the pressure kick through the ports 23. It will be understood that the arrangement described is capable of permitting virtually full reverse flow in the event of a severe pressure kick.

In the event that it becomes necessary to deploy wireline tools downhole, straight-through access to the drillstring is gained by first dropping a cone-tipped sinker on a wireline into the kelly or top drive so that the sinker tip penetrates the stressed surface of the glass disc 21 causing the latter to disintegrate. Wireline tools may then be deployed; and a new or fresh glass disc may be fitted subsequently. The choice of a toughened soda-lime glass is preferred because this material reliably disintegrates to a fine particulate condition, thus reducing the risk of larger glass fragments impeding or interfering with the wireline tools.

Figure 2:
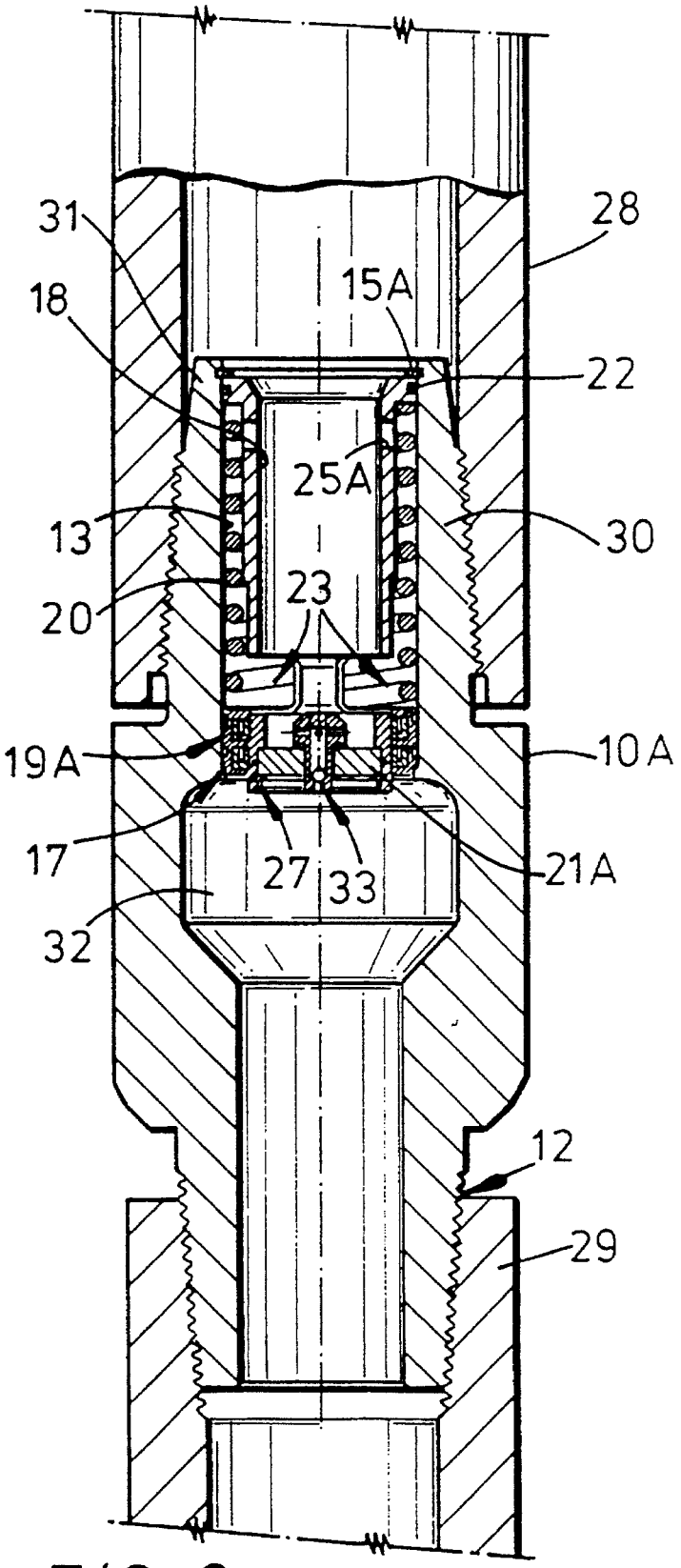
FIG. 2 is a sectional elevation similar to FIG. 1, but showing a second embodiment of a check valve in accordance with the present invention and connected with parts of a top drive and a drillstring.

In FIG. 2 of the drawings, parts corresponding with those in FIG. 1 are given the reference numerals used in FIG. 1.

In FIG. 2, the body 10A of the check valve is configured as a saver sub which is used in the industry as the preferred connection between a top drive shaft 28 and drillstring 29. The downstream pin of a saver sub can be recut to compensate for wear resulting from repeated connection/disconnection to and from the drillstring. When further recutting of the saver sub is impossible, then the entire saver sub is relatively cheap to replace.

Particularly in a top drive arrangement, there is a practical limit to the axial dimension of saver sub which can be accommodated without compromising the vertical action, of the top drive arrangement. Accordingly, the check valve described with reference to FIG. 1 above may not be suitable with some top drive arrangements.

In order to accomplish an axially compact check valve, the tubular valve member 18 and the sleeve seal 19A of FIG. 2 are accommodated substantially within the upstream hollow pin 30 of the saver sub. Moreover, the pin 30 is provided with an upstream non-threaded extension 31 which is accommodated within the top drive shaft 28 and provides additional axial length whereby the appropriate check valve action can be accomplished having regard to required spring rate of the spring 20 and the necessary travel of the tubular valve member 18.

A conventional standard saver sub has a straight-through bore. However, the present saver sub has an enlarged middle portion defining a chamber 32 which accommodates the downstream end portion of the tubular valve member 18 and discharge from the ports 23 when the check valve is actioned by operation of the mud pumps.

In the FIG. 2 embodiment, the toughened soda-lime glass disc 21A carries a relatively small check valve 33 of the ball-check type and which is fitted to the glass disc 21A through a central opening therein. The check valve 33 allows a driller to detect pressures within the drillstring with the main check valve closed and with the circulation stopped. It will be understood that the small check valve 33 is disposable in the event that the facility for wire-line access is used.

In the FIG. 2 embodiment, the upstream stop means consists of a circlip 15A. Also, the annular space occupied by the compression spring 20 is vented to the inside of the tubular valve member 18 through openings 25A. Also, the sleeve seal 19A, as can be seen by inspection of the drawing of FIG. 2, consists of a moulded sleeve casing with inserted ring-seals.

I claim:

1. A check valve for connection with the top end of a drillstring as a mud saver, comprising a tubular valve member (18) axially shiftable within a tubular body (10, 10A) through a sleeve seal (19, 19A) mounted in the body (10, 10A) and which cooperates with ports (23) in the wall of the tubular valve member (18) which ports (23) are disposed adjacent a downstream end of the tubular valve member (18), spring means (20) urging the tubular valve member (18) in the upstream direction and into abutment with a first stop means, and a closure (21, 2A) closing the downstream end of the tubular valve member (18); characterized in that the sleeve seal (19,19A) is axially shiftable in the body (10, 10A) in an upstream direction away from a second stop means (17), and in that the said spring means (20) urges the sleeve seal (19A) in the downstream direction.

2. A check valve according to claim 1, characterized in that the closure (21, 21A) is of a frangible material.

3. A check valve according to claim 1, characterized in that the closure (21, 21A) is a disc of toughened glass.

4. A check valve according to claim 3 characterized in that the closure (21, 21A) is a disc of toughened soda-lime glass.

5. A check valve according to claim 1 characterized in that the closure (21A) has a second check valve (33) mounted therein.

6. A check valve according to claim 1 characterized in that the body (10A) is a saver sub having an upper externally screw-threaded hollow pin (30) for connection with a drive member (28), and in that the said tubular valve member (18) is housed within said hollow pin (30).

7. A check valve according to claim 6, characterized in that said hollow pin (30) has an upstream non-threaded extension (31).

8. A check valve for connection with the top end of a drillstring as a mud saver, comprising a tubular valve member (18) axially shiftable within a tubular body (10A) through a sleeve seal (19A) mounted in the body (10A) and which cooperates with ports (23) in the wall of the tubular valve member (18) which ports (23) are disposed adjacent a downstream end of the tubular valve member (18), spring means (20) urging the tubular valve member (18) in the upstream direction and into abutment with a first stop means, and a closure (21A) closing the downstream end of the tubular valve member (18); characterized in that the body (10A) is a saver sub having an upper externally screw-threaded hollow pin (30) for connection with a drive member (28), and in that the said tubular valve member (18) is housed within said hollow pin (30).

9. A check valve according to claim 8; characterized in that said hollow pin (30) has an upstream non-threaded extension (31).

* * * * *

UNITED STATES PATENT AND TRADEMARK OFFICE

CERTIFICATE OF CORRECTION

PATENT NO. : 5,479,988

DATED : January 2, 1996

INVENTOR(S) : Robert P. Appleton

It is certified that error appears in the above-identified patent and that said Letters Patent is hereby corrected as shown below: On the title page: Item [73]

Item [73], Assignee: please add --Donald Stewart Milne, Kincardineshire, United Kingdom--.

Signed and Sealed this

Seventeenth Day of June, 1997

Bruce Lehman

*Attest:*

BRUCE LEHMAN

*Attesting Officer*

*Commissioner of Patents and Trademarks*